US012454961B1

(12) United States Patent
Lin et al.

(10) Patent No.: US 12,454,961 B1
(45) Date of Patent: Oct. 28, 2025

(54) CENTRIFUGAL FAN

(71) Applicant: ASUSTEK COMPUTER INC., Taipei (TW)

(72) Inventors: Hsin-Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 19/017,949

(22) Filed: Jan. 13, 2025

(30) Foreign Application Priority Data

Oct. 18, 2024 (TW) ..... 113139724

(51) Int. Cl.
*F04D 29/28* (2006.01)
*F04D 17/08* (2006.01)
*F04D 29/42* (2006.01)

(52) U.S. Cl.
CPC ..... *F04D 29/281* (2013.01); *F04D 17/08* (2013.01); *F04D 29/424* (2013.01)

(58) Field of Classification Search
CPC ..... F04D 17/08; F04D 29/424
See application file for complete search history.

(56) References Cited

U.S. PATENT DOCUMENTS 10,718,355 B2 * 7/2020 Lin ..... F04D 29/666
2011/0176916 A1 * 7/2011 Liang ..... F04D 29/663 415/203

FOREIGN PATENT DOCUMENTS

| | | | | |
|---|---|---|---|---|
| CN | 202125460 | U | | 1/2012 |
| CN | 110296104 | A | | 10/2019 |
| CN | 111434927 | A | | 7/2020 |
| CN | 115653935 | A | * | 1/2023 |
| CN | 116292392 | A | * | 6/2023 |
| TW | 201640026 | A | | 11/2016 |

* cited by examiner

*Primary Examiner* — Danielle M. Christensen
(74) *Attorney, Agent, or Firm* — Muncy, Geissler, Olds & Lowe, P.C.

(57) ABSTRACT

A centrifugal fan provided includes an upper cover, a lower cover, a fan frame, and a fan blade module. The upper cover has an upper air inlet with an upper air inlet radius. The fan blade module includes a hub, a connecting ring, a plurality of inner ring blades, and a plurality of outer ring blades. The connecting ring surrounds the hub and forms an inner ring region and an outer ring region around the hub. The plurality of inner ring blades is connected to the hub and the connecting ring and circularly arranged in the inner ring region. The plurality of outer ring blades is connected to the connecting ring and circularly arranged in the outer ring region. The connecting ring has an inner radius and an outer radius. The outer radius is greater than the upper air inlet radius. Two adjacent outer ring blades are of different shapes.

9 Claims, 11 Drawing Sheets

CENTRIFUGAL FAN

CROSS-REFERENCE TO RELATED APPLICATION

This application claims the priority benefit of Taiwan Application Serial No. 113139724, filed on Oct. 18, 2024. The entirety of the above-mentioned patent application is hereby incorporated by reference herein and made a part of specification.

BACKGROUND OF THE INVENTION

Field of the Invention

The disclosure relates to a fan, and in particular, to a centrifugal fan for heat dissipation of an electronic device.

Description of the Related Art

A centrifugal fan includes a plurality of blades circularly arranged on a periphery of a central hub, and air is sucked into a space among blades along an axial direction of the central hub through rotation of the blades, and then discharged outward along a centrifugal direction of the rotation of the blades.

When the centrifugal fan is applied to a thin notebook computer, due to a relatively small system space, narrow spaces are left between an upper cover of the fan and a housing and between a lower cover of the fan and the housing, and air needs to pass through the narrow spaces before flowing to an air inlet of the fan. Narrow spaces result in an increase in an airflow velocity. High-speed airflow impacts the blades of the fan blade module when entering the air inlet, and because the blades are circularly arranged around the central hub at a fixed spacing, the airflow impact forms an audio noise of a specific frequency, which causes interference to users.

BRIEF SUMMARY OF THE INVENTION

The disclosure provides a centrifugal fan. The centrifugal fan includes an upper cover, a lower cover, a fan frame, and a fan blade module. The lower cover has a lower air inlet. The upper cover has an upper air inlet. The upper air inlet has an upper air inlet radius. The fan frame is located between the upper cover and the lower cover. The fan frame, the upper cover, and the lower cover form a space. The fan blade module is arranged in the space and includes a hub, a connecting ring, a plurality of inner ring blades, and a plurality of outer ring blades. The connecting ring surrounds the hub and forms an inner ring region and an outer ring region around the hub. The plurality of inner ring blades is connected to the hub and the connecting ring and circularly arranged in the inner ring region. The plurality of outer ring blades is connected to the connecting ring and circularly arranged in the outer ring region. The connecting ring has an inner radius and an outer radius. The outer radius is greater than the upper air inlet radius. Two adjacent outer ring blades are of different shapes.

The fan blade module of the centrifugal fan provided in the disclosure has an inner ring blade, an outer ring blade, and a connecting ring. An arrangement position of the connecting ring corresponds to an edge (that is, a position where an airflow velocity in the air inlet is faster) of the air inlet, so as to effectively guide air to enter the blades and provide an effect of airflow rectification. In addition, two adjacent outer ring blades of the fan blade module in the disclosure are of different shapes, so that time points at which the adjacent outer ring blades are subjected to airflow impact are slightly different, and a frequency of noise generated by the airflow impact is prevented from being concentrated at a same frequency, which is beneficial to reduce audio noise.

DETAILED DESCRIPTION OF THE EMBODIMENTS

Specific embodiments of the disclosure are described in more detail below with reference to the schematic diagrams. Advantages and features of the disclosure are to be clearer based on the following descriptions and claims. It is to be noted that all figures are in a very simple form and in an inaccurate proportion, and are merely intended to assist in convenient and clear description of the embodiments of the disclosure.

Figure 1A:
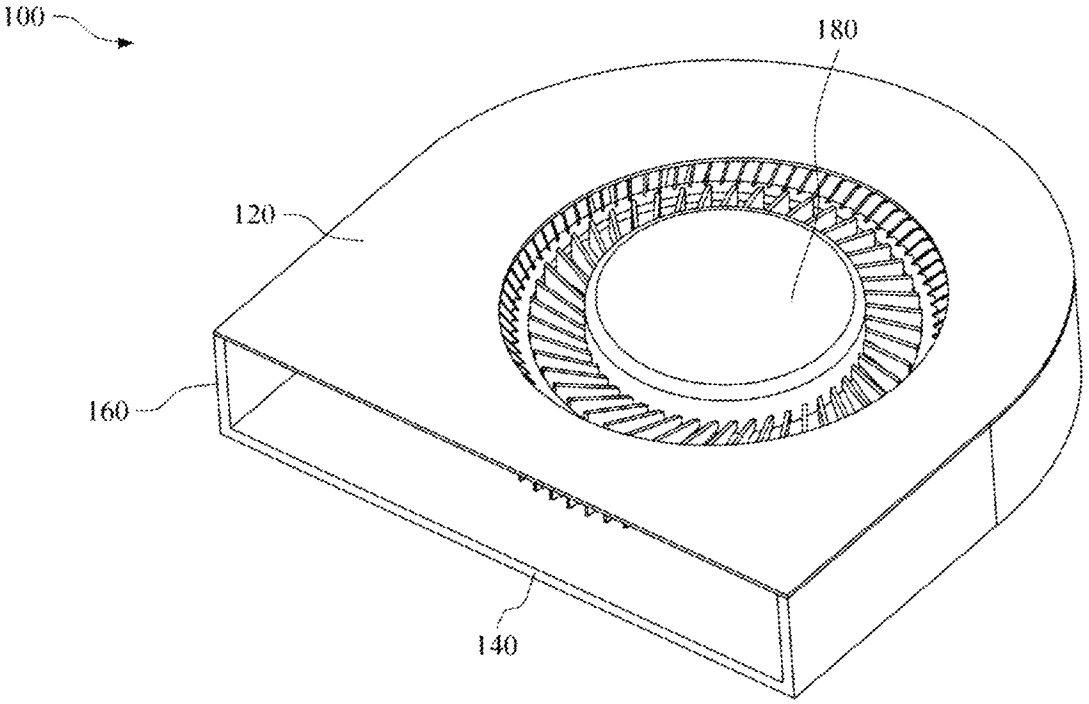
FIG. 1A is a schematic three-dimensional view of a centrifugal fan according to a first embodiment of the disclosure.
Figure 1B:
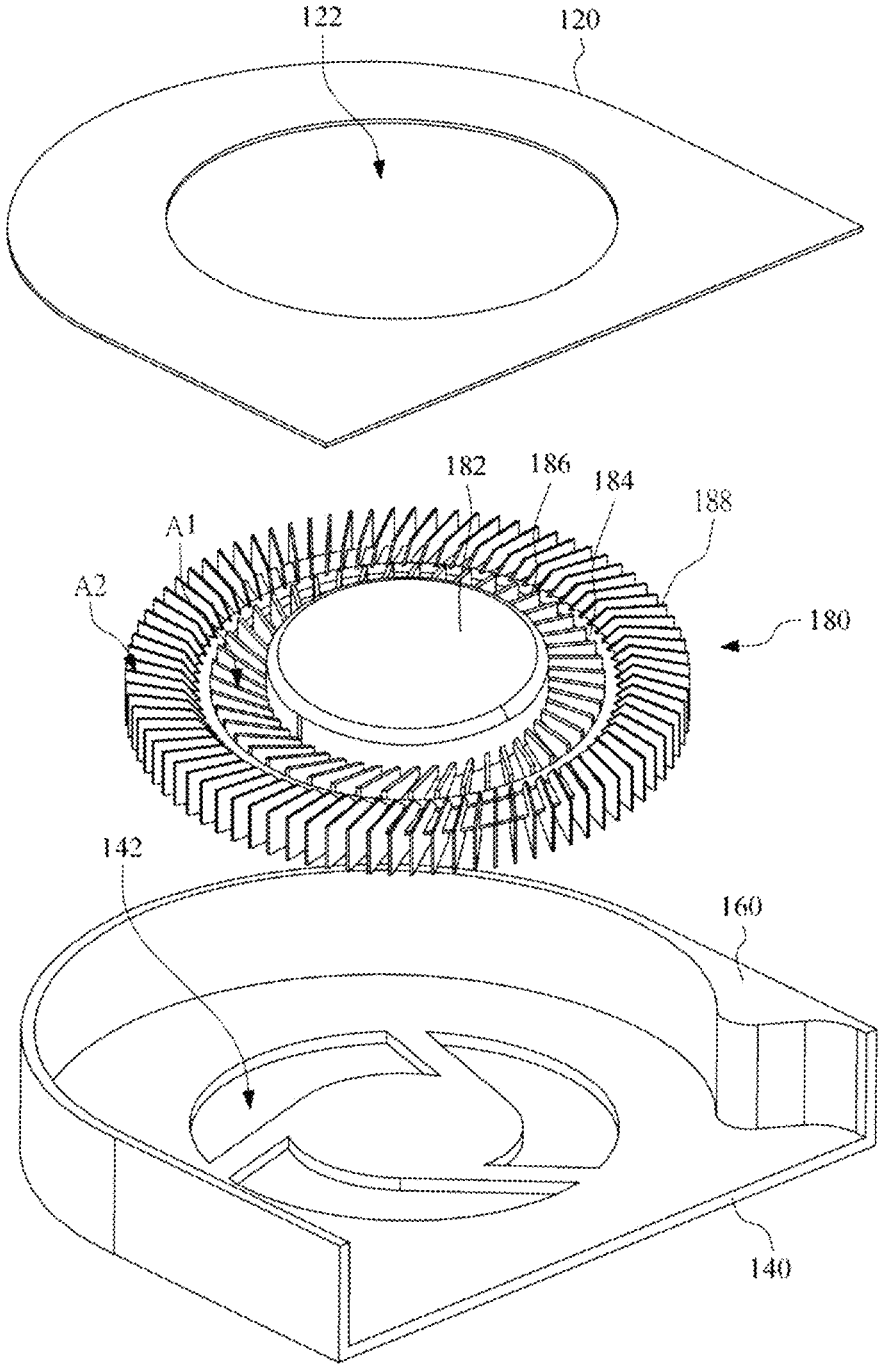
FIG. 1B is a schematic exploded view of a centrifugal fan in FIG. 1A.
Figure 2:
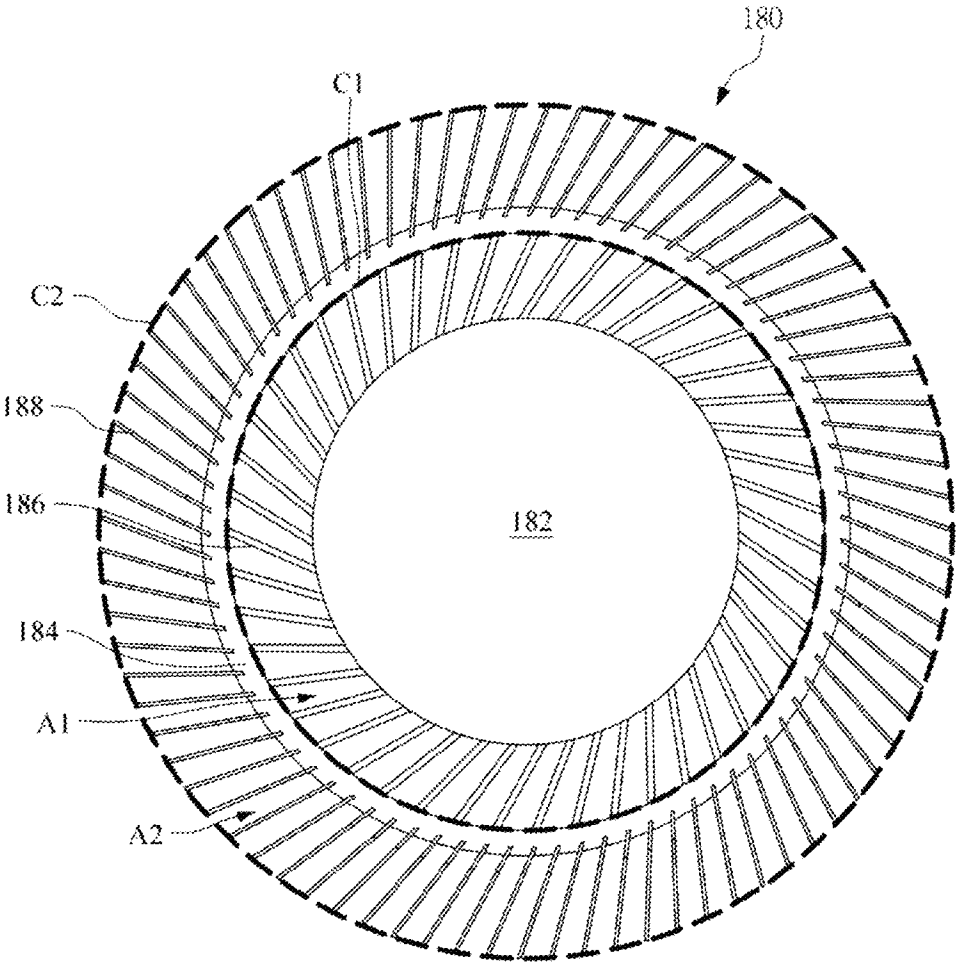
FIG. 2 is a schematic top view of a fan blade module in FIG. 1A.
Figure 3:
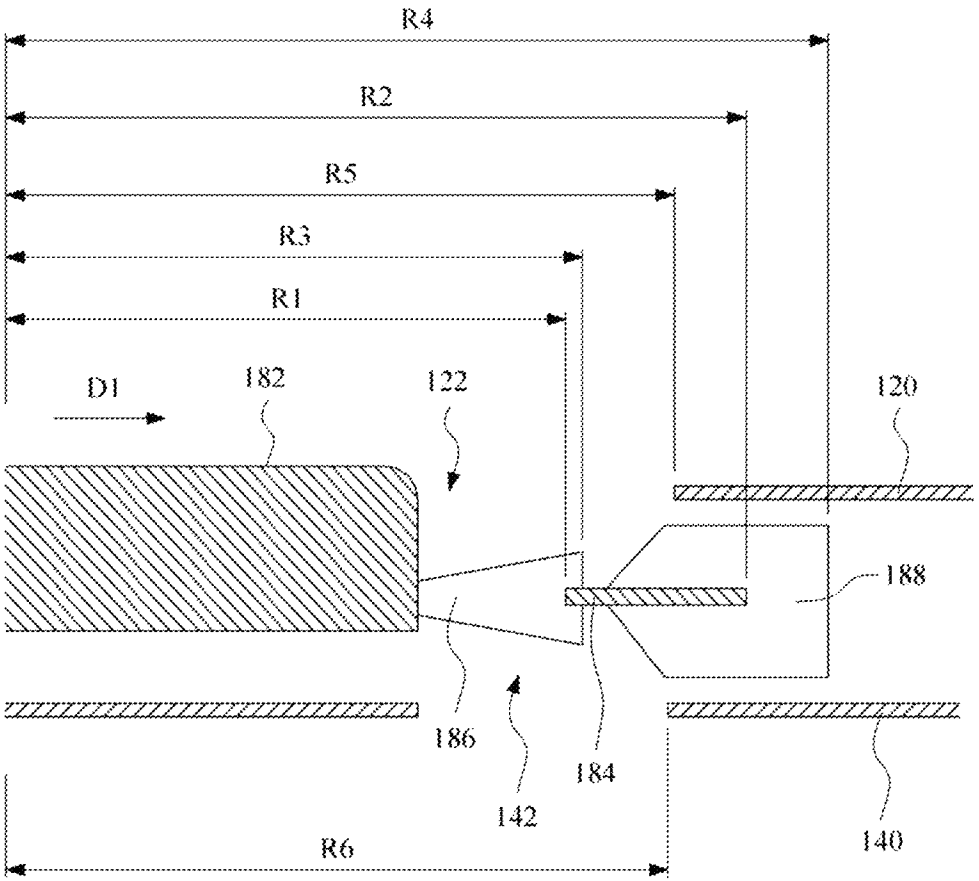
FIG. 3 is a schematic cross-sectional view of a centrifugal fan in FIG. 1A.

FIG. 1A is a schematic three-dimensional view of a centrifugal fan 100 according to a first embodiment of the disclosure. FIG. 1B is a schematic exploded view of a centrifugal fan 100 in FIG. 1A. FIG. 2 is a schematic top view of a fan blade module in FIG. 1A. FIG. 3 is a schematic cross-sectional view of a centrifugal fan 100 in FIG. 1.

As shown in the figure, a centrifugal fan 100 provided in this embodiment includes an upper cover 120, a lower cover 140, a fan frame 160, and a fan blade module 180.

The upper cover 120 has an upper air inlet 122. The upper air inlet 122 is circular. The lower cover 140 has a lower air inlet 142. In the figure, the lower air inlet 142 is composed of three independent regions, and peripheries of the regions collectively form a circular region.

The fan frame 160 is located between the upper cover 120 and the lower cover 140. The fan frame 160, the upper cover 120, and the lower cover 140 form a space.

The fan blade module 180 is arranged in the space and includes a hub 182, a connecting ring 184, a plurality of inner ring blades 186, and a plurality of outer ring blades 188.

As shown in FIG. 2, the connecting ring 184 surrounds the hub 182 and forms an inner ring region A1 and an outer ring region A2 around the hub 182. The plurality of inner ring blades 186 is connected to the hub 182 and the connecting ring 184 and circularly arranged in the inner ring region A1. The plurality of outer ring blades 188 is connected to the connecting ring 184 and circularly arranged in the outer ring region A2. In an embodiment, a quantity of the outer ring blades 188 is greater than a quantity of the inner ring blades 186, which is beneficial to improve the overall heat dissipation performance of the fan.

Referring to FIG. 2 and FIG. 3 together, the connecting ring 184 has an inner radius R1 and an outer radius R2. The surrounding range of the inner ring blades 186 defines an inner circle C1. The inner circle C1 has an inner circle radius R3. A surrounding range of the outer ring blades 188 defines an outer circle C2. The outer circle C2 has an outer circle radius R4. The upper air inlet 122 has an upper air inlet radius R5, and the lower air inlet 142 has a lower air inlet radius R6.

The inner radius R1 is less than the inner circle radius R3. The outer radius R2 is greater than the upper air inlet radius R5 and the lower air inlet radius R6, but less than the outer circle radius R4.

In an embodiment, the inner radius R1 is less than 60% of the outer circle radius R4, and the outer radius R2 is less than 95% of the outer circle radius R4. In this way, it is ensured that an arrangement position of the connecting ring 184 corresponds to a region (that is, a position close to an edge of the upper air inlet 122) with a higher airflow velocity in the upper air inlet 122, so that an incoming airflow flows smoothly to the center of the outer blades 188, and the airflow can be blocked and guided by the connecting ring 184 to reduce a speed of the airflow before the airflow enters the outer ring blades and reduce an airflow impact intensity generated by the airflow for the outer ring blades 188, thereby effectively reducing blade pass frequency noise.

In addition, as shown in FIG. 3, a radial cross-section of the connecting ring 184 in this embodiment is in a shape of a rectangle, and a long side direction of the rectangle is parallel to a radial direction D1 of the fan blade module 180. However, the disclosure is not limited thereto.

Figure 4A:
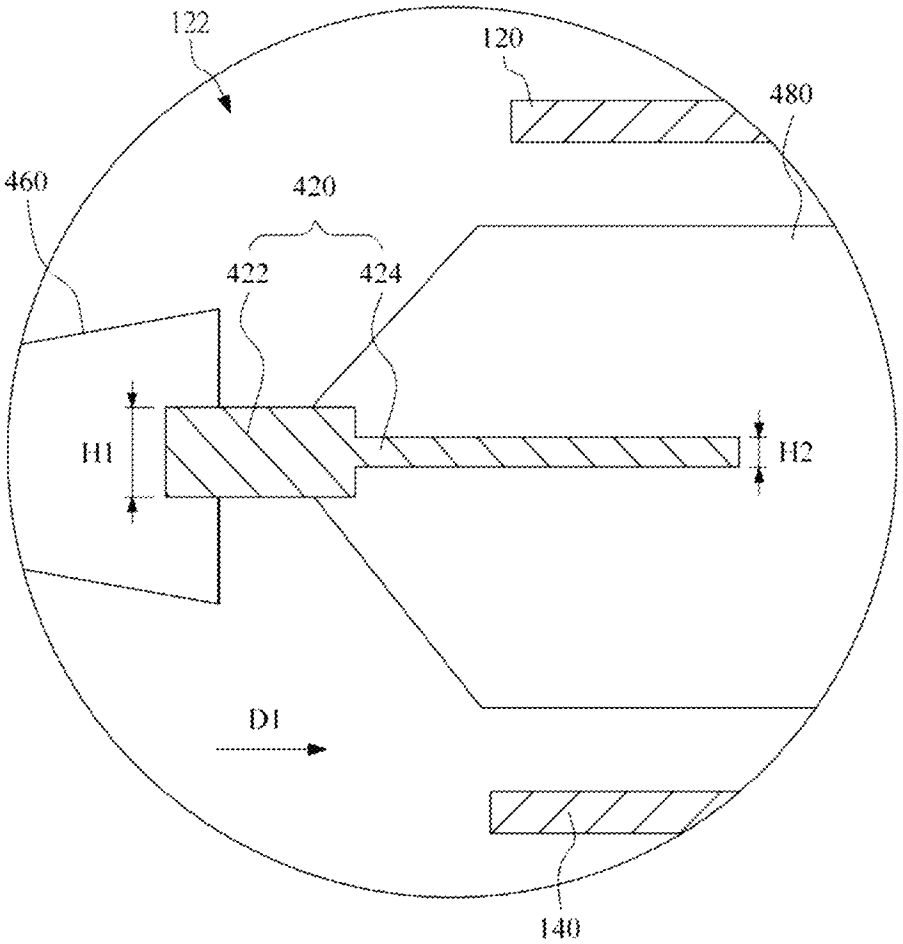
FIG. 4A to FIG. 4C show three different section designs of a connecting ring of the disclosure.
Figure 4B:
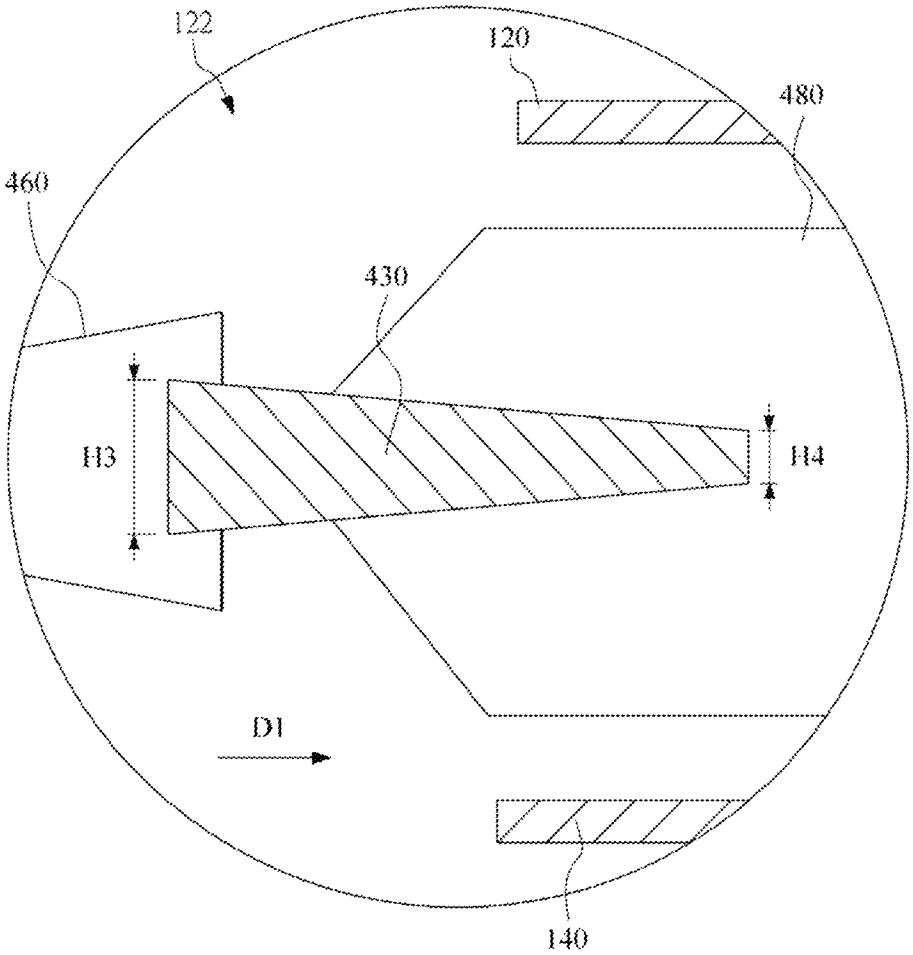
Figure 4C:
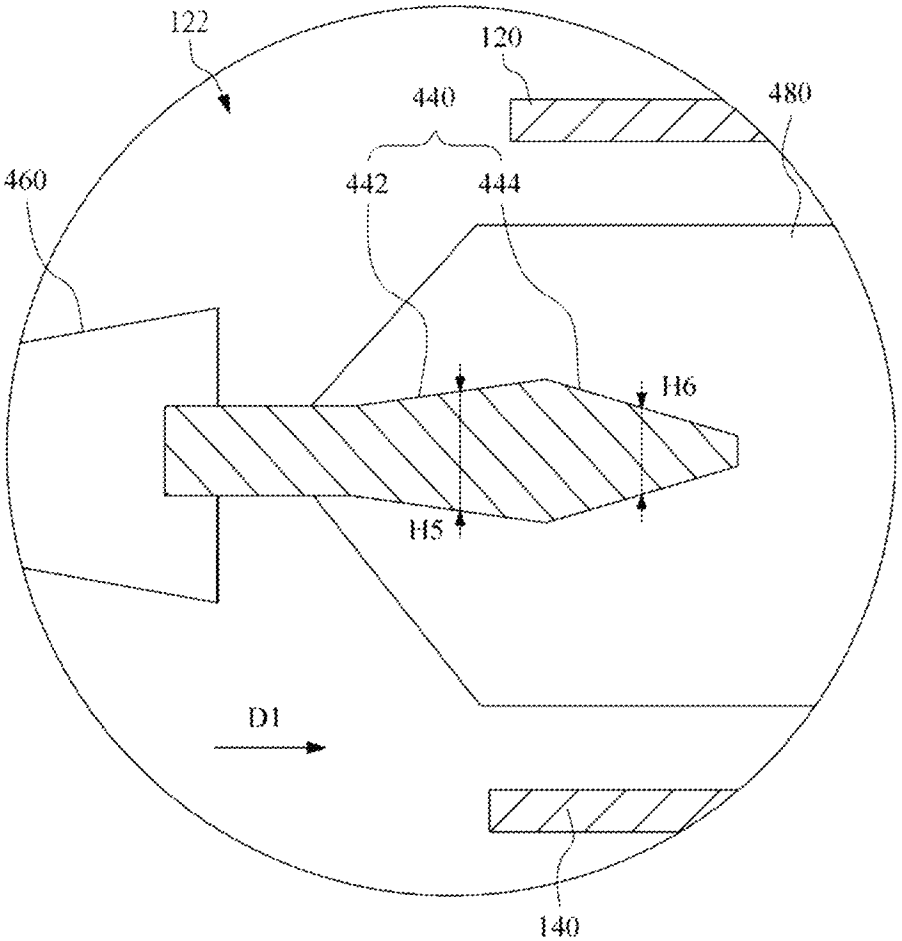

FIG. 4A to FIG. 4C show three different section designs of a connecting ring of the disclosure. The figures each show a structure of the connecting ring in a radial cross-section.

In the embodiment of FIG. 4A, the connecting ring 420 has a first portion 422 and a second portion 424 in sequence from inside to outside along the radial direction D1, and a height H1 of the first portion 422 is greater than a height H2 of the second portion 424, thereby presenting a stepped structure. The first portion 422 connects the inner ring blades 460 and the outer ring blades 480, and the second portion 424 extends outward from the first portion 422 in a direction away from the hub (not shown).

In the embodiment of FIG. 4B, the connecting ring 430 has a first height H3 on a side facing the hub (not shown). The connecting ring 430 has a second height H4 on a side away from the hub (not shown). The first height H3 is greater than the second height H4, so that the radial cross-section of the connecting ring 430 is in a shape of a trapezoid.

In the embodiment of FIG. 4C, the connecting ring 440 has a first portion 442 and a second portion 444 in sequence from inside to outside along the radial direction D1. The first portion 442 connects the inner ring blades 460 and the outer ring blades 480, and the second portion 444 extends outward from the first portion 442 in a direction away from the hub (not shown). A height H5 of the first portion 442 gradually increases from the inside to the outside along the radial direction D1. A height H6 of the second portion 444 gradually decreases from the inside to the outside along the radial direction D1.

In addition, in the first embodiment of the disclosure, all of the outer ring blades 188 of the fan blade module 180 are of the same shape. However, the disclosure is not limited thereto. In another embodiment, the outer ring blades of different shapes are matched, so that two adjacent outer ring blades 188 of the fan blade module 180 have different shapes, so as to avoid the noise generated by the airflow impact at a single frequency, to further reduce the noise generated by the airflow impact.

Figure 5A:
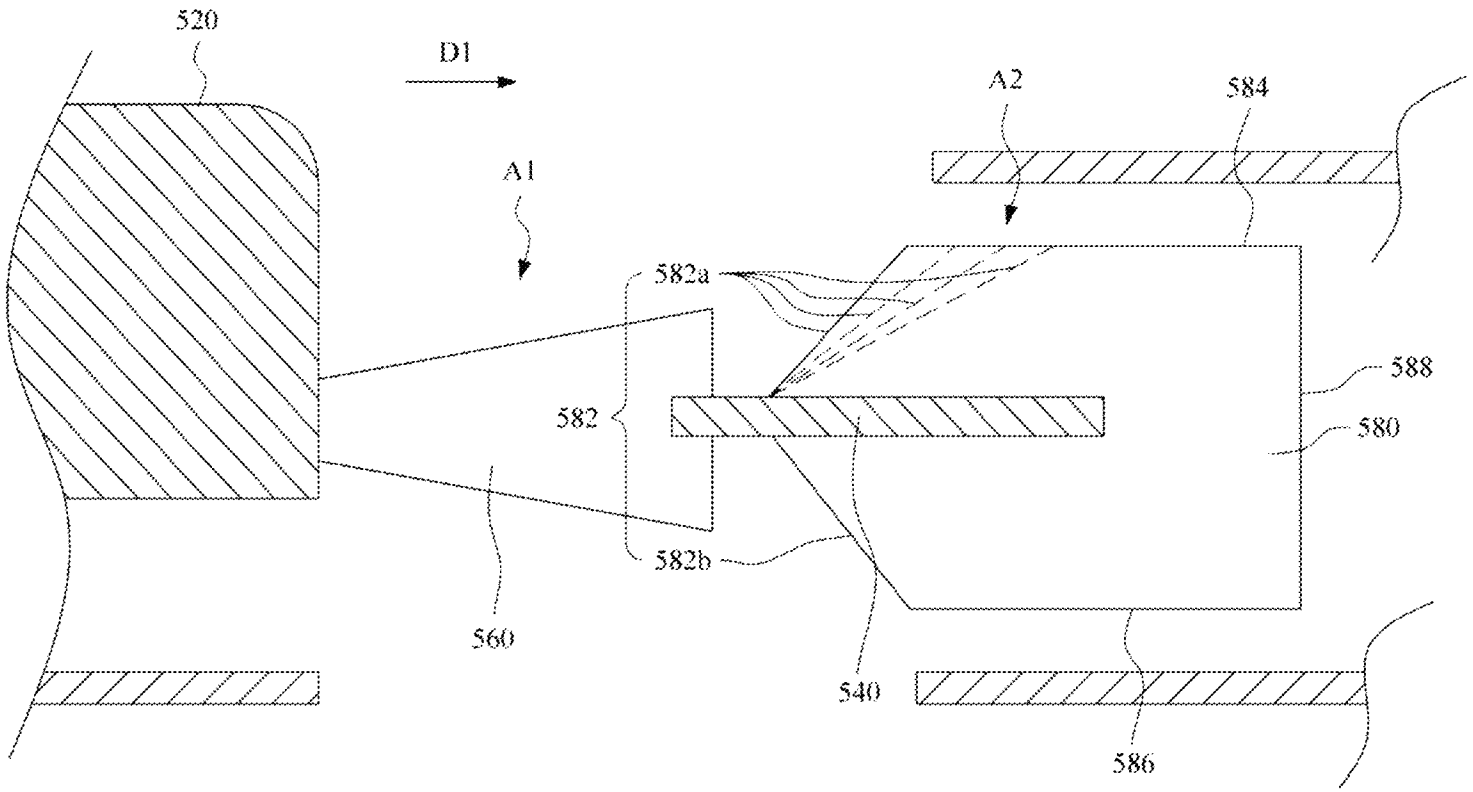
FIG. 5A and FIG. 5B are schematic cross-sectional and three-dimensional views of a fan blade module according to a second embodiment of the disclosure.
Figure 5B:
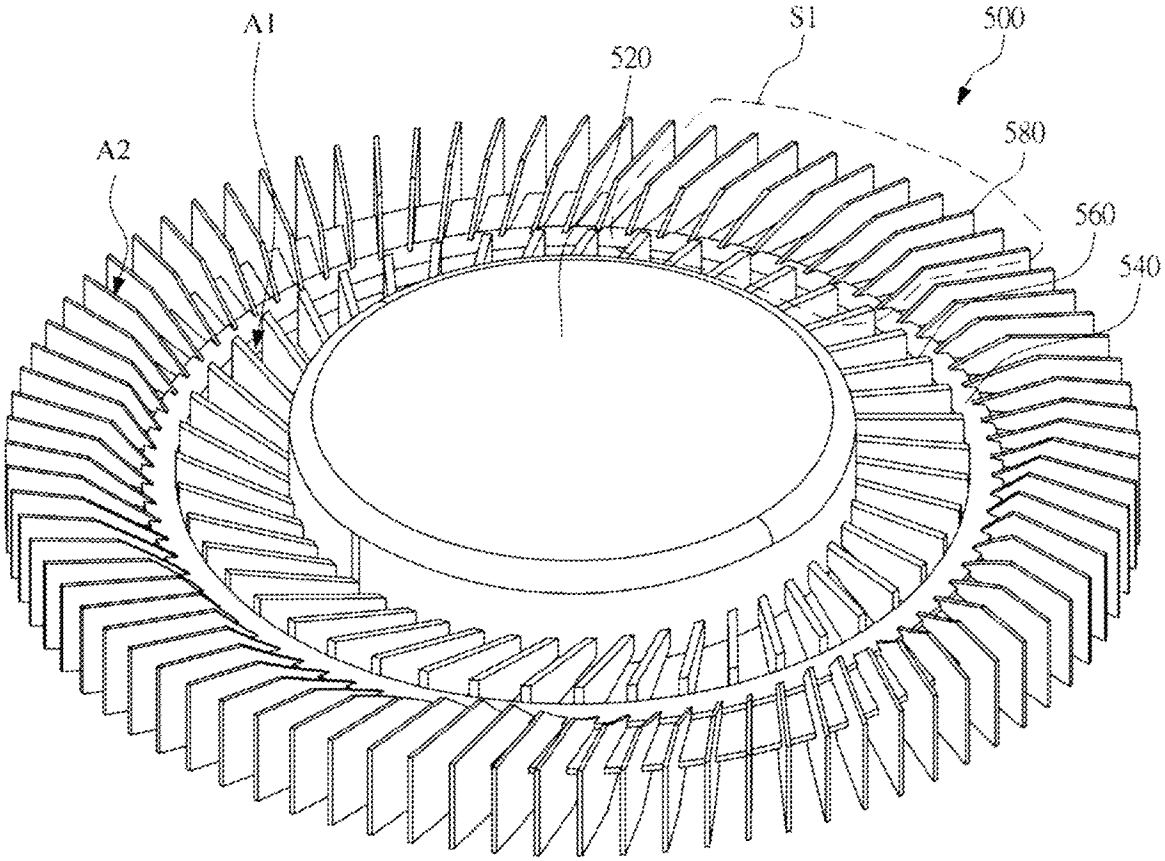

FIG. 5A and FIG. 5B are schematic cross-sectional and three-dimensional views of a fan blade module 500 according to a second embodiment of the disclosure.

As shown in the figure, the fan blade module 500 includes a hub 520, a connecting ring 540, a plurality of inner ring blades 560, and a plurality of outer ring blades 580.

The outer ring blades 580 are divided into a plurality of blade sets S1 (only one of the blade sets is shown in the figure) circularly arranged in an outer ring region A2 in sequence. Each blade set S1 has a same quantity of blades. Further, in an embodiment, the blade sets S1 are symmetrically distributed around the hub 520.

Next, the blade set S1 of this embodiment includes at least three types of outer ring blades 580 (in the figure, a single blade set S1 has 11 outer ring blades 580). The foregoing at least three types of outer ring blades 580 are arranged according to a preset rule.

Specifically, each of the outer ring blades 580 of this embodiment is defined by an inner edge 582, an upper edge 584, a lower edge 586, and an outer edge 588. The inner edge 582 is divided into an upper portion 582*a* and a lower portion 582*b* by using the connecting ring 540 as a boundary. In this embodiment, slopes of the upper portions 582*a* of the inner edges 582 of two adjacent outer ring blades 580 are set to be different, so that the adjacent outer ring blades 580 present different shapes. Further, the outer ring blades 580 in the blade set S1 of this embodiment are arranged based on the slopes of the upper portions 582*a* of the inner edges 582 relative to the radial direction D1. As shown in the figure, the outer ring blades of the blade sets S1 are arranged in descending order and then in ascending order of the slopes of the upper portions 582*a* of the inner edges 582 relative to the radial direction D1.

However, the disclosure is not limited thereto. In another embodiment, the slopes of the lower portions 582*b* of the inner edges 582 of the outer ring blades 580 are also changed, so that the adjacent outer ring blades 580 present different shapes. Alternatively, the slopes of the upper portions 582*a* and the lower portions 582*b* of the inner edges 582 of the outer ring blades 580 are simultaneously changed, so that the adjacent outer ring blades 580 present different shapes. Further, the outer ring blades 580 in each blade set S1 are also arranged according to another preset rule, such as a size of a blade area.

Figure 6A:
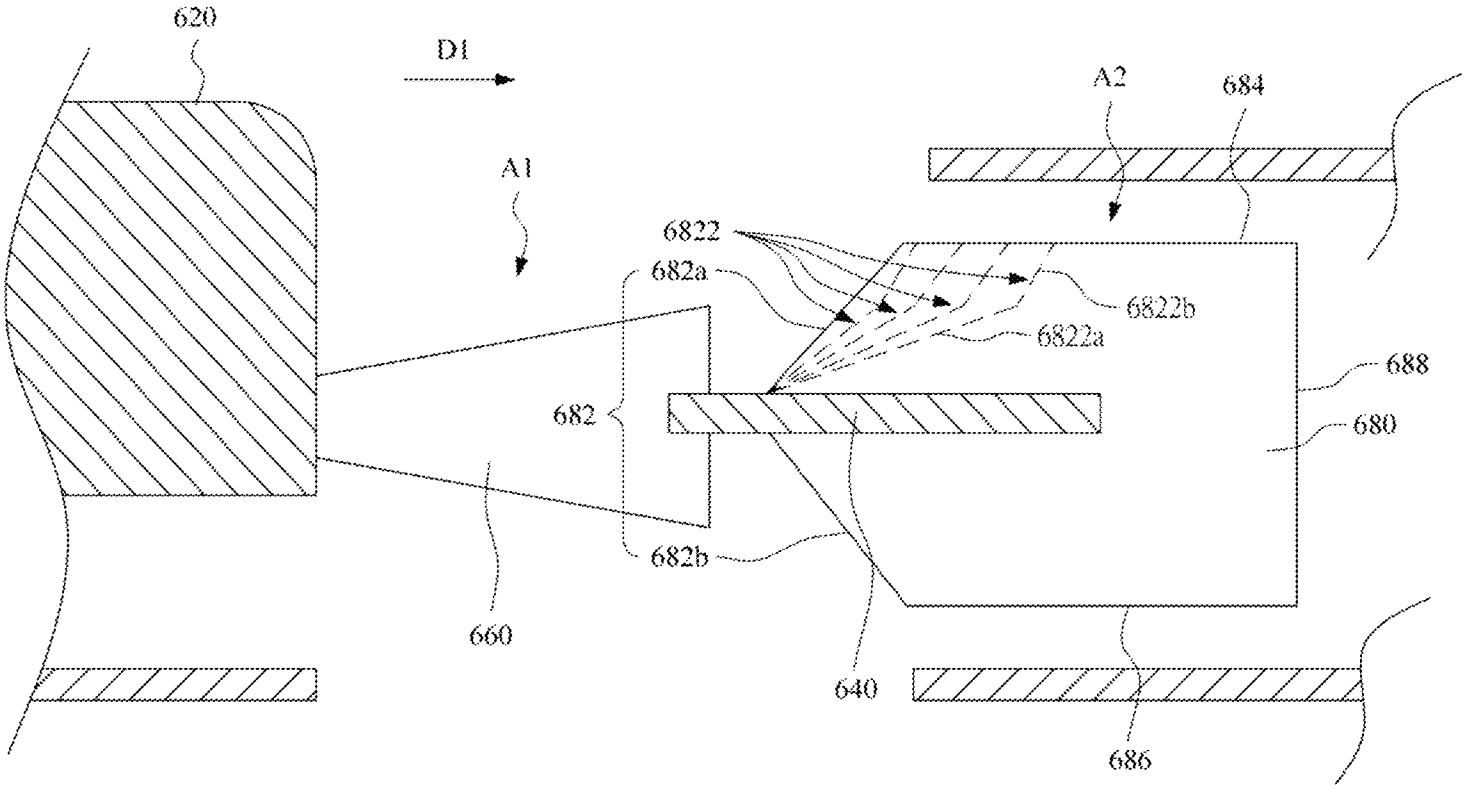
FIG. 6A and FIG. 6B are schematic cross-sectional and three-dimensional views of a fan blade module according to a third embodiment of the disclosure.
Figure 6B:
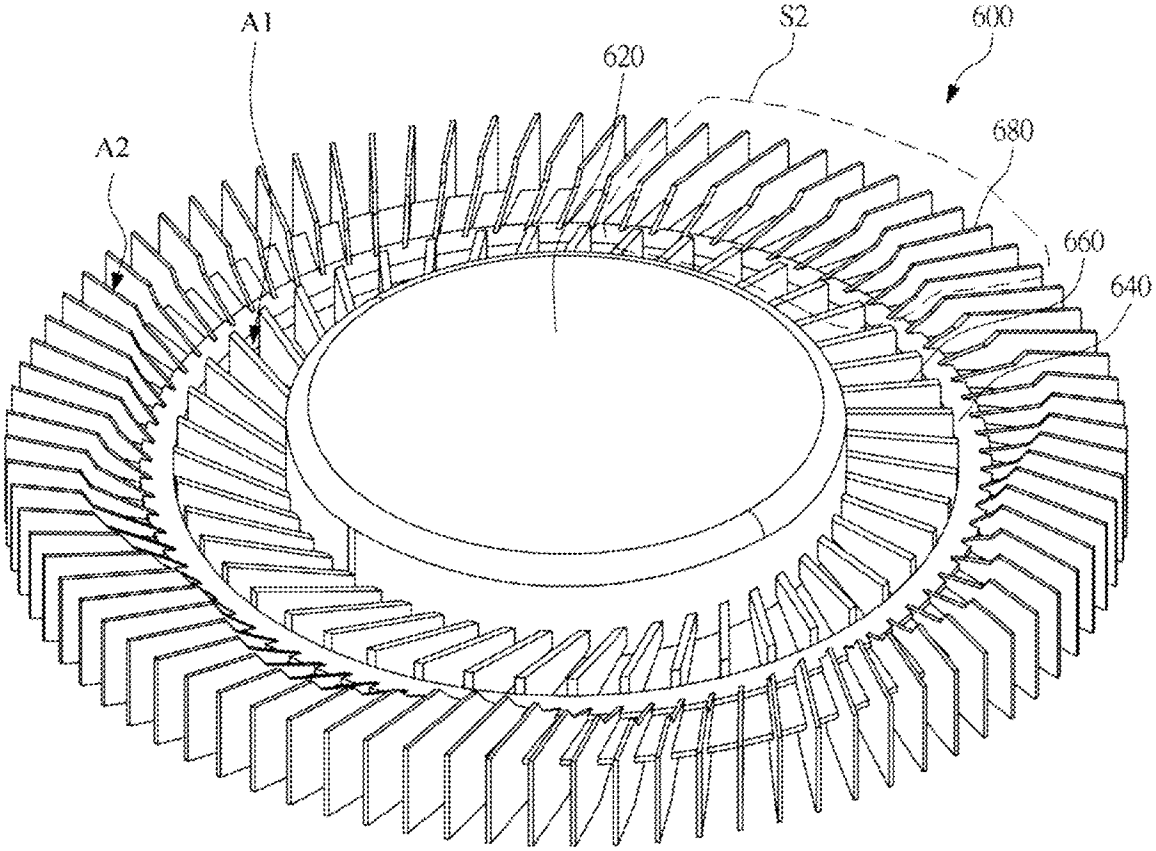

FIG. 6A and FIG. 6B are schematic cross-sectional and three-dimensional views of a fan blade module 600 according to a third embodiment of the disclosure.

As shown in the figure, the fan blade module 600 includes a hub 620, a connecting ring 640, a plurality of inner ring blades 660, and a plurality of outer ring blades 680.

Similar to the embodiments of FIG. 5A and FIG. 5B, the outer ring blades 680 of this embodiment are divided into a plurality of blade sets S2 (only one of the blade sets is shown in the figure) circularly arranged in an outer ring region A2 in sequence.

Each of the outer ring blades 680 is defined by an inner edge 682, an upper edge 684, a lower edge 686, and an outer edge 688. The inner edge 682 is divided into an upper portion 682*a* and a lower portion 682*b* by using the connecting ring 640 as a boundary. The upper portion 682*a* of the inner edge 682 has a notch 6822. In this embodiment, the notches 6822 of the upper portions 682*a* of the inner edges 682 of two adjacent outer ring blades 680 are of different sizes, thereby presenting different shapes. Further, the outer ring blades 680 in the blade sets S2 of this embodiment are arranged based on the sizes of the notches 6822. In an embodiment, a position of each of the notches 6822 substantially corresponds to a position of the connecting ring 640.

In this embodiment, the notch 6822 is defined by a first side edge 6822*a* and a second side edge 6822*b*. The first side edge 6822*a* extends obliquely from the connecting ring 640 in a direction toward the upper cover (not shown) and away from the hub. The second side edge 6822*b* is connected to a tail end of the first side edge 6822*a*, and also extends obliquely in the direction toward the upper cover (not shown) and away from the hub. However, a slope of the second side edge 6822*b* is greater than that of the first side edge 6822*a*. A triangular notch 6822 is formed on the inner edges 682 of the outer ring blades 680.

Next, in this embodiment, the size of the notches 6822 of the upper portion 682*a* of the inner edge 682 of the outer ring blade 680 is changed, so that the adjacent outer ring blades 682 present different shapes. However, the disclosure is not limited thereto. In another embodiment, the notch 6822 is also formed on the lower portion 682*b* of the inner edge 682 of the outer ring blade 680. The size of the notch 6822 on the lower portion 682*b* of the inner edge 682 of the outer ring blade 680 is changed, so that the adjacent outer ring blades 682 present different shapes. Alternatively, the notch 6822 is formed on both the upper portion 682*a* and the lower portion 682*b* of the inner edge 682 of the outer ring blade 680, and the sizes of the notches 6822 of the upper portions 682*a* and the lower portion 682*b* of the inner edge 682 of the outer ring blade 680 are changed simultaneously, so that the adjacent outer ring blades 680 present different shapes.

The fan blade modules 180, 500, and 600 of the centrifugal fan 100 provided in the disclosure have inner ring blades 186, 560, and 660, outer ring blades 188, 580, and 680, and connecting rings 184, 540, and 640. An arrangement position of each of the connecting rings 184, 540, and 640 corresponds to the edge (that is, the position where the airflow velocity in the air inlet is faster) of the air inlet (that is, an upper air inlet 122 of an upper cover 120 or a lower air inlet 142 of a lower cover 140), so as to effectively guide the air to enter the outer ring blades 188, 580, and 680 and provide an effect of airflow rectification. In addition, two adjacent outer ring blades 188, 580, and 680 of the fan blade modules 180, 500, and 600 of the disclosure are of different shapes, so that time points at which the adjacent outer ring blades 188, 580, and 680 are subjected to airflow impact are slightly different, and a frequency of noise generated by the airflow impact is prevented from being concentrated at a same frequency, which is beneficial to further reduce audio noise.

The above descriptions are merely preferred embodiments of the disclosure, and do not impose any limitation on the disclosure. Any form of change such as an equivalent replacement or modification made by any person skilled in the art to technical means and technical content disclosed in the disclosure without departing from scope of the technical means of the disclosure is content that does not deviate from the technical means of the disclosure, and still falls within protection scope of the disclosure.

What is claimed is:

1. A centrifugal fan, comprising:

an upper cover, having an upper air inlet, wherein the upper air inlet has an upper air inlet radius;

a lower cover, having a lower air inlet;

a fan frame, located between the upper cover and the lower cover, wherein the fan frame, the upper cover, and the lower cover form a space; and a fan blade module, arranged in the space and comprising:

a hub;

a connecting ring, surrounding the hub and forming an inner ring region and an outer ring region around the hub;

a plurality of inner ring blades, connected to the hub and the connecting ring and circularly arranged in the inner ring region; and a plurality of outer ring blades, connected to the connecting ring and circularly arranged in the outer ring region, wherein the connecting ring has an inner radius and an outer radius, and the outer radius is greater than the upper air inlet radius; and two adjacent outer ring blades are of different shapes, the plurality of outer ring blades is divided into a plurality of blade sets that is circularly arranged in the outer ring region in sequence, each of the blade sets comprises at least three types of outer ring blades, and the at least three types of outer ring blades are arranged according to a preset rule.

2. The centrifugal fan according to claim 1, wherein a quantity of the outer ring blades is greater than a quantity of the inner ring blades.

3. The centrifugal fan according to claim 1, wherein a surrounding range of the outer ring blades defines an outer circle, the outer circle has an outer circle radius, and the outer radius is less than 95% of the outer circle radius.

4. The centrifugal fan according to claim 1, wherein the lower air inlet has a lower air inlet radius, and the outer radius is greater than the lower air inlet radius.

5. The centrifugal fan according to claim 1, wherein each of the outer ring blades comprises an inner edge, an upper edge, a lower edge, and an outer edge, the inner edge comprises an upper portion and a lower portion, and the upper portions of two adjacent outer ring blades are of different shapes.

6. The centrifugal fan according to claim 1, wherein each of the outer ring blades comprises an inner edge, an upper edge, a lower edge, and an outer edge, the inner edge comprises an upper portion and a lower portion, and the lower portions of two adjacent outer ring blades are of different shapes.

7. The centrifugal fan according to claim 1, wherein each of the outer ring blades comprises an inner edge, an upper edge, a lower edge, and an outer edge, the inner edge comprises an upper portion and a lower portion, and the upper portions and the lower portions of two adjacent outer ring blades are of different shapes.

8. The centrifugal fan according to claim 1, wherein each of the outer ring blades comprises an inner edge, an upper edge, a lower edge, and an outer edge, the inner edge comprises an upper portion and a lower portion, and the at least three types of outer ring blades are arranged based on a slope of the upper portion.

9. The centrifugal fan according to claim 1, wherein each of the outer ring blades comprises an inner edge, an upper edge, a lower edge, and an outer edge, the inner edge comprises an upper portion and a lower portion, the upper portion has a notch, and the at least three types of outer ring blades are arranged based on a size of the notch.

* * * * *